US005813540A

United States Patent [19]

Vollbrecht et al.

[11] Patent Number: 5,813,540

[45] Date of Patent: Sep. 29, 1998

[54] SHRINK FILM-ENCASED DOUBLE-TIERED PACKAGE

[75] Inventors: Robert A. Vollbrecht, Doylestown, Pa.; Scott P. Leuschke, Alexandria, Minn.

[73] Assignee: Douglas Machine Limited Liability Company, Alexandria, Minn.

[21] Appl. No.: 765,993

[22] PCT Filed: Nov. 13, 1995

[86] PCT No.: PCT/US95/14545

§ 371 Date: Jan. 2, 1997

§ 102(e) Date: Jan. 2, 1997

[87] PCT Pub. No.: WO96/23708

PCT Pub. Date: Aug. 8, 1996

Related U.S. Application Data

[63] Continuation-in-part of Ser. No. 337,325, Nov. 10, 1994, abandoned.

[51] Int. Cl.[6] ..... B65D 65/00

[52] U.S. Cl. ..... 206/497; 206/427; 206/432; 53/442

[58] Field of Search ..... 206/427, 432, 206/433, 497, 770; 53/442, 447

[56] References Cited

U.S. PATENT DOCUMENTS

| | | | |
|---|---|---|---|
| Re. 27,212 | 11/1971 | Brown . | |
| 2,151,472 | 3/1939 | Hubbard . | |
| 3,050,228 | 8/1962 | Lane . | |
| 3,217,874 | 11/1965 | Potter | 206/432 |
| 3,338,404 | 8/1967 | Becker et al. . | |
| 3,347,365 | 10/1967 | Funkhouser | 53/442 |
| 3,353,326 | 11/1967 | Becker | 53/442 |
| 3,425,543 | 2/1969 | Harvey . | |
| 3,425,544 | 2/1969 | Ayer et al. . | |
| 3,478,950 | 11/1969 | Stevens . | |
| 3,656,614 | 4/1972 | Jacobson | 206/497 |
| 3,826,357 | 7/1974 | Roth . | |
| 3,878,943 | 4/1975 | Ryan et al. | 53/442 |
| 4,036,362 | 7/1977 | Ullman . | |
| 4,289,236 | 9/1981 | Ganz et al. . | |
| 4,427,108 | 1/1984 | Coles et al. . | |
| 4,471,870 | 9/1984 | Uhlig . | |
| 4,799,350 | 1/1989 | Rias | 53/442 |
| 4,919,265 | 4/1990 | Lems et al. . | |
| 4,998,615 | 3/1991 | Bryan . | |

*Primary Examiner*—David T. Fidei
*Attorney, Agent, or Firm*—Peterson, Wicks, Nemer & Kamrath, P. A

[57] ABSTRACT

A package (10) is disclosed including stacked, lower and upper trays (12, 14) each including end walls (22, 122) extending on opposite sides of a base panel (16, 116). The handgrips (26) of the end walls (22) of the lower tray (12) are aligned with the handgrips (126) of the end walls (122) of the upper tray (14) when it is stacked on the lower tray (12). The openings (38) in the ends of a shrunk film wrapper (36) are at least partially coincident with the upper peripheries of the handgrips (26, 126) for providing extra strength. Side walls (18, 118) are integrally connected to the base panels (16, 116) about fold lines (20, 120) and are secured to the end walls (22, 122) by tabs (28, 34, 128, 134). The trays (12, 14) are formed of paperboard and/or corrugated from one or more blanks. In preferred forms of the present invention, the upper edges (27, 127) of the end walls (22, 122) of the lower and upper trays (12, 14) are integrally connected about fold lines, with the end walls (22) of the lower tray (12) including tear strips (40) allowing the lower and upper trays (12, 14) to be separated for distribution.

27 Claims, 4 Drawing Sheets

SHRINK FILM-ENCASED DOUBLE-TIERED PACKAGE

CROSS REFERENCE

The present application is the national phase of international application No. PCT/US 95/14545 filed Nov. 13, 1995 which is a continuation-in-part of abandoned U.S. application Ser. No. 08/337,325 filed Nov. 10, 1994.

BACKGROUND

The present invention relates generally to packaging, particularly to shrink film-encased packaging, and specifically to double-tiered, shrink film-encased packaging.

Typically, soda pop cans are sold in paperboard packages of a rectangular parallelepiped construction and recently in packages in the shape of a cube. Conventional paperboard packages are designed to be carried by a single handle which has many shortcomings. Specifically, a single handle places too much weight in one hand and also has a tendency to place the person carrying the package off balance. Also, a single handle is often relatively weak on many packages and tends to fail, allowing the package to fall and in some instances crushing or at least hitting the feet and toes of the person carrying the package or person(s) standing nearby.

Although double-tiered, shrink film-encased packages have been available, their market acceptance in the sale of soda pop cans has been limited. Specifically, prior double-tiered, shrink film-encased packages did not lend themselves to be carried by only a single hand, with typically it being required that two hands be inserted below and on opposite sides of the base panel of either the upper or lower trays for carrying.

Thus, a need continues to exist for an improved package providing improved handgrips allowing the package to be carried either by a single hand or both hands and without the tendency of the handgrip to fail, especially when carried by a single hand. Furthermore, such a need also exists for a double-tiered package which is competitive with conventional packages including those formed exclusively of paperboard.

SUMMARY

The present invention solves these needs and other problems in the packaging field by providing, in the preferred form, first and second openings formed in a shrink wrapper encasing products supported on a base panel of a tray, with the openings being at least partially coincident with the upper peripheries of the handgrips formed in the end walls of the tray to provide extra strength to the handgrips.

In other aspects of the present invention, both upper and lower trays include handgrips formed in each of the end walls which are aligned when the trays are stacked in a double-tiered package, with the upper and lower trays and the products contained therein being encased by a shrink wrapper.

It is thus an object of the present invention to provide novel shrink film-encased packaging.

It is further an object of the present invention to provide such novel shrink film-encased packaging including strengthened handgrips which are not prone to fail.

It is further an object of the present invention to provide such novel shrink film-encased packaging which can be conveniently carried utilizing one or two handgrips.

It is further an object of the present invention to provide such novel shrink film-encased packaging formed of readily recyclable components.

It is further an object of the present invention to provide such novel shrink film-encased packaging which minimizes packaging costs.

It is further an object of the present invention to provide such novel shrink film-encased packaging offering security with regard to product tamper resistance.

It is further an object of the present invention to provide such novel shrink film-encased packaging allowing only portions of the package to be run through printing.

It is further an object of the present invention to provide such novel shrink film-encased packaging allowing ease of selective promotion offerings.

It is further an object of the present invention to provide such novel shrink film-encased packaging of a double-tier construction.

These and further objects and advantages of the present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figures 1, 2, 3:
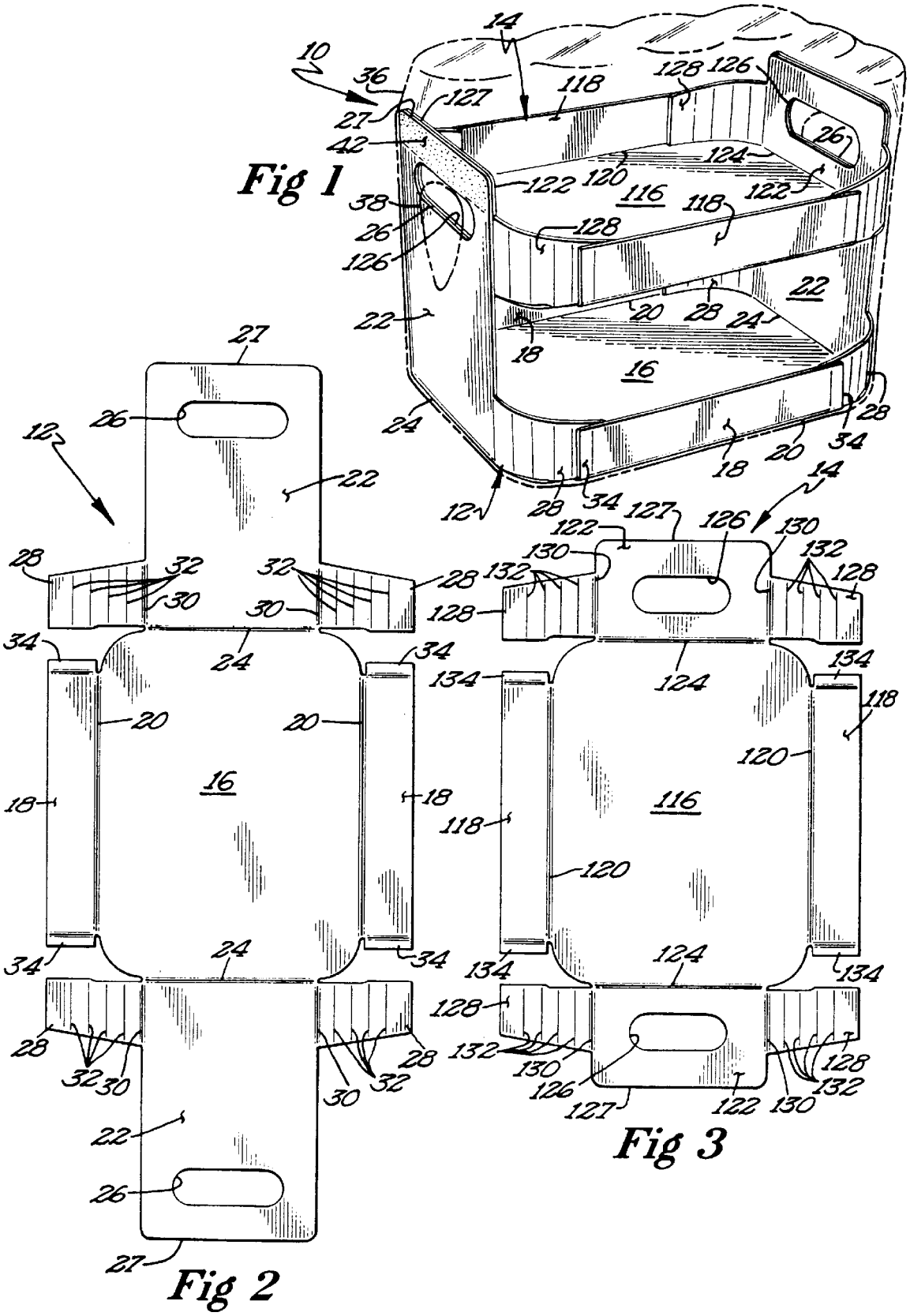
FIG. 1 shows a perspective view of a shrink film-encased, double-tiered package according to the preferred teachings of the present invention.
FIGS. 2–6 show top plan views of alternate forms of blanks which can be utilized to construct the shrink film-encased, double-tiered package of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "inside", "outside", "front", "back", "outer", "inner", "upper", "lower", "height", "width", "length", "end", "side", "horizontal", "vertical", and similar terms are used herein, it should be understood that these terms have reference only to the structure shown in the drawings as it would appear to a person viewing the drawings and are utilized only to facilitate describing the invention.

DESCRIPTION

Shrink film-encased, double-tiered packages according to the preferred teachings of the present invention are shown in the drawings and generally designated 10. Package 10 is formed from lower and upper trays 12 and 14. In a first preferred form, trays 12 and 14 are formed from two, individual blanks of paperboard or corrugated. In particular, lower tray 12 is formed from a blank as best seen in FIG. 2 and includes a base panel 16 which is substantially rectangular in plan and with rounded corners in the most preferred form. Side walls 18 of substantially rectangular configurations are joined to base panel 16 about parallel spaced fold lines 20. End walls 22 of substantially rectangular configurations are joined to base panel 16 about parallel spaced fold lines 24 which are perpendicular to fold lines 20. In the preferred form shown, the width of end walls 22 is less than the width of base panel 16. A notch serving as a handgrip 26 is located adjacent to the free, upper edge 27 of end wall 22. Tabs 28 are joined to end walls 22 about parallel spaced fold lines 30 which are perpendicular to fold lines 24 and parallel to fold lines 20, with fold lines 30 located inside and intermediate fold lines 20. In the most preferred form, tabs 28 are segmented about a multiplicity of fold lines 32 which are parallel to and spaced from fold lines 30. Likewise, in the preferred form shown, glue tabs 34 are optionally formed on the opposite ends of side walls 18. Lower tray 12 can be erected in any suitable manner, typically after end walls 22 are folded to extend perpendicular to base panel 16 and an array of products located on base panel 16. Thereafter, tabs 28 can be tucked in and side walls 18 folded to extend perpendicular to base panel 16, with tabs 34 suitably secured to tabs 28 such as by glue or similar adhesive.

Upper tray 14 includes a base panel 116 which is substantially rectangular in plan and with rounded corners in the most preferred form. Side walls 118 of substantially rectangular configurations are joined to base panel 116 about parallel spaced fold lines 120. End walls 122 of substantially rectangular configurations are joined to base panel 116 about parallel spaced fold lines 124 which are perpendicular to fold lines 120. In the preferred form shown, the width of end walls 122 is less than the width of base panel 116. A notch serving as a handgrip 126 is located adjacent to the free, upper edge 127 of end wall 122. Tabs 128 are joined to end walls 122 about parallel spaced fold lines 130 which are perpendicular to fold lines 124 and parallel to fold lines 120, with fold lines 130 located inside and intermediate fold lines 120. In the most preferred form, tabs 128 are segmented about a multiplicity of fold lines 132 which are parallel to and spaced from fold lines 130. Likewise, in the preferred form shown, glue tabs 134 are optionally formed on the opposite ends of side walls 118. Upper tray 14 can be erected in any suitable manner, typically after end walls 122 are folded to extend perpendicular to base panel 116 and an array of products located on base panel 116. Thereafter, tabs 128 can be tucked in and side walls 118 folded to extend perpendicular to base panel 116, with tabs 134 suitably secured to tabs 128 such as by glue or similar adhesive.

In the most preferred form, base panels 16 and 116 have the same width between fold lines 20 and 120, respectively, with the length between fold lines 124 of panel 116 being generally equal to but slightly smaller than the length between fold lines 24 of panel 16. End walls 22 and 122 have an identical width between fold lines 30 and 130, respectively. The length of end walls 122 between fold lines 124 and edge 127 is generally equal to the difference of the length of end walls 22 between fold line 24 and edge 27 and the height of the products contained in tray 12. Hand grips 26 and 126 are at corresponding, aligned locations when base panel 116 is supported upon the upper ends of the products contained in tray 12, with end walls 122 located inward of end walls 22. Side walls 18 and tabs 28 and 34 in the preferred form have a size and shape corresponding and equal to side walls 118 and tabs 128 and 134, respectively.

Figure 4:
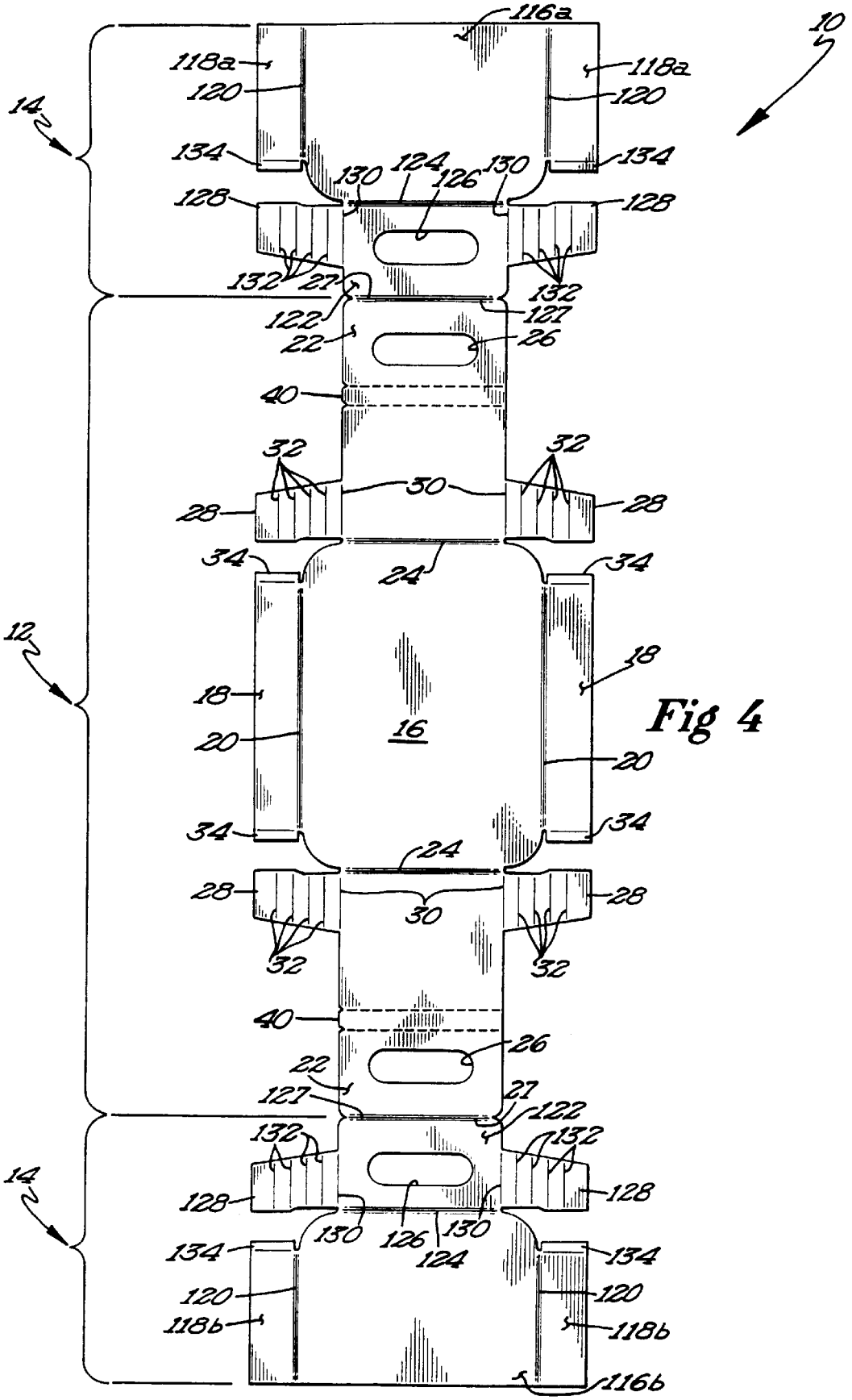

In another preferred form of the present invention, trays 12 and 14 are formed from a single blank of paperboard or corrugated as best seen in FIG. 4. In the blank of FIG. 4, base panel 116 and side walls 118 are divided into two portions 116*a* and 116*b* and 118*a* and 118*b* of a length slightly greater than one-half of the length of base panel 116 and side walls 118. Thus, the free edges of portions 116*a*, 116*b*, 118*a*, and 118*b* of the one-piece blank can be overlapped and secured together by any suitable means such as glue to form the unitary base panel 116 and the unitary side walls 118. Further, upper edges 27 and 127 of end walls 22 and 122 on the same sides of trays 12 and 14 are integrally connected together about a fold line in the blank of FIG. 4. To allow separation of trays 12 and 14 when desired, a tear strip 40 is provided in each end wall 22 of the blank of FIG. 4 at a spacing from edge 27 equal to the spacing of fold line 124 from edge 127.

Similarly, trays 12 and 14 could be formed from a single blank similar to FIG. 4 wherein base panel 116 is separated at one of the fold lines 124 from one of the end walls 122, with a glue tab optionally provided to one or both of the separated fold lines 124 of panel 116 and end wall 122. Likewise, with base panel 116 separated at one of the fold lines 124 from one of the end walls 122, another end wall 122 including a corresponding handgrip 126 could be provided on the separated fold line 124 of panel 116 such that the handle on one end of package 10 would be formed including three layers of paperboard or corrugated.

Figure 5:
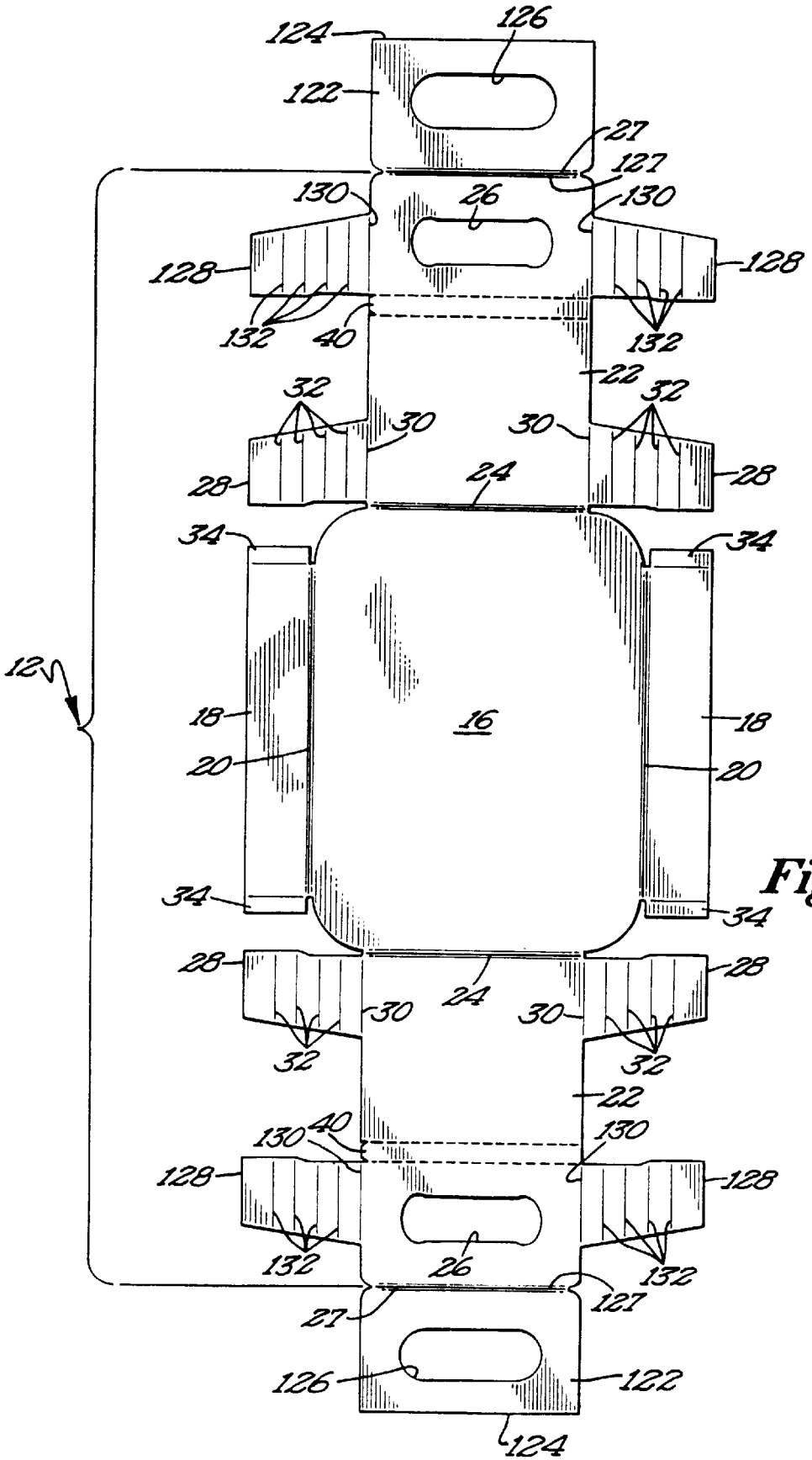
Figure 6:
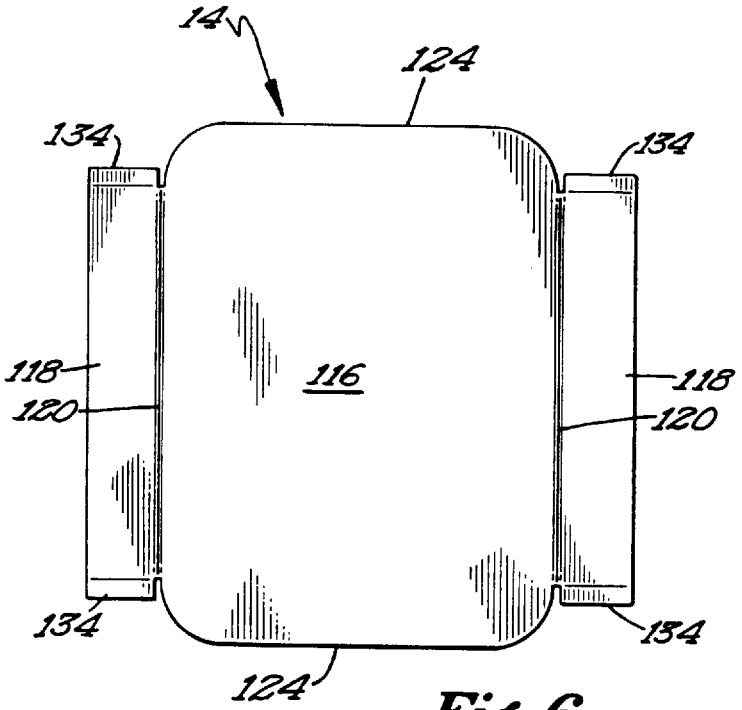

In an alternate form of the present invention, trays 12 and 14 are formed from two blanks of paperboard or corrugated as best seen in FIGS. 5 and 6. In the blanks of FIGS. 5 and 6, end walls 122 are separated from and not directly connected to base panel 116 and upper edges 27 and 127 of end walls 22 and 122 on the same sides of trays 12 and 14 are integrally connected together about a fold line in the blank of FIG. 5. To allow separation of trays 12 and 14 when desired, tear strip 40 is provided in each end wall 22 of the blank of FIG. 5 at a spacing from edge 27 equal to the spacing of fold line 124 from edge 127. It can then be appreciated that when tab 128 is secured to tab 134 and/or side wall 118, tray 14 is secured to end walls 22 and 122. In the form shown in FIG. 5, tabs 128 are joined to end walls 22 about parallel spaced fold lines 130, with end walls 122 being joined to end walls 22 through the integral connection of edges 27 and 127.

Figure 7:
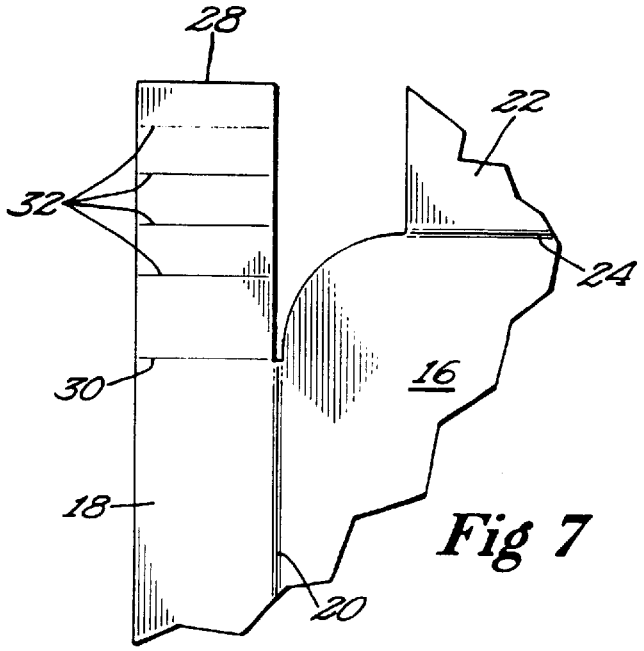
FIG. 7 shows a partial, top plan view of a blank which can be utilized to construct the lower tray of the shrink film-encased, double-tiered package of FIG. 1.

In the preferred forms shown in FIGS. 2–6, tabs 28 and 128 are integrally connected to end walls 22 and/or 122. However, it can be appreciated that tabs 28 and 128 could be integrally connected to side walls 18 and 118 about fold lines 30 and 130, respectively, in a manner as shown in FIG. 7 for tabs 28. Tabs 28 and 128 can then be secured to end walls 22 and/or 122 by any suitable means such as glue, with tabs 34 and 134 optionally being provided on end walls 22 and/or 122 if desired.

Package 10 according to the teachings of the present invention further includes a wrapper 36 of flexible heat shrinkable thermoplastic film material, for example low-density polyethylene. Wrapper 36 is enfolded around upper tray 14 stacked upon lower tray 12 and their contents and is sealed and inserted into a shrink tunnel in a known manner. The shrunk wrapper 36 draws walls 18, 22, 118 and 122 against the products in trays 12 and 14 and draws tabs 28 and 128 against the other peripheries of the corners of the array of products held in trays 12 and 14. The shrunk wrapper 36 closely embraces the tops of the products in tray 14 and generally closely embraces the exposed sides of the products in trays 12 and 14 and so maintains and tightly encases and packs the products within trays 12 and 14 and by virtue of this gives strength to trays 12 and 14 since walls 18, 22, 118, and 122 act to reinforce the edges of base panels 16 and 116 against bending. In the most preferred form, the shrunk wrapper 36 includes first and second openings 38 which are at least partially coincident to handgrips 26 and 126 and in particular to the upper peripheries of handgrips 26 and 126. Thus, upward forces on the handles of package 10 according to the preferred teachings of the present invention are transferred to the upper peripheries of handgrips 26 and 126 as well as of openings 38 to provide extra strength.

In the most preferred form, shrunk wrapper 36 is adhered to the outside surface of end walls 22 by a suitable adhesive 42 extending between the upper periphery of handgrip 26 and upper edge 27 and between the side edges of end walls 22. In particular, adhesive 42 in the preferred form is head activated and applied to end walls 22 such as on the blank forming tray 12 or such as after set-up and prior to wrapper 36 being enfolded around trays 12 and 14 and their contents. In any case, when heat is being applied to shrink wrapper 36, adhesive 42 should be activated to adhere between end walls 22 and the portions of wrapper 36 extending beyond end walls 22 which are drawn against end wall 22 to form openings 38. Adhering wrapper 36 further enhances the strength of handgrips 26 and 126 and specifically reduces the tendency of end walls 22 and 122 to tear between handgrips 26 and 126 and upper edges 27 and 127. Such tearing can be a problem if package 10 is held by only one hand and especially when package 10 is pulled from a shelf by only one hand with the opposite end being allowed to swing down, with the weight and momentum of package 10 placing considerable stress on end walls 22 and 122.

Before enfolding or shrinking, wrapper 36 can be provided with printed material either in a continuous pattern which will produce random placement of the printed material on package 10 or in a registered pattern which allows a positive placement on package 10. Additionally, a perforation or other opening means can be added on wrapper 36 having printed material in a registered pattern to allow ease of opening of wrapper 36 after it is shrunk on package 10.

It can be appreciated that package 10 according to the preferred teachings of the present invention is believed to be advantageous for several reasons. First, the handles for carrying package 10 formed by handgrips 26 and 126 as well as by wrapper 36 have increased strength over the handles of conventional packages and thus are less likely to fail. Specifically, in addition to the extra strength provided by wrapper 36 and the enhanced tear resistance provided by adhesive 42, the handles have increased strength because two layers of paperboard or corrugated are provided by end walls 22 and 122. Further, increased strength results when edges 27 and 127 are integrally connected together about a fold line according to the teachings of the present invention such as when package 10 is formed from the blanks of FIGS. 4–6. In the most preferred form, end walls 122 are glued to end walls 22 for providing extra rigidity and strength to the handles. In this regard, end walls 22 and 122 could be preglued by the blank manufacturer such as in the blanks of FIGS. 4 and 5 so that gluing is not required in the packaging process. It can then be appreciated that package 10 can be carried by two handles on opposite ends of package 10 for better control by the consumer or at the option of the consumer can be carried utilizing only a single handle for example when only one hand is available. Thus, the shortcomings of prior packages have been overcome by the present invention.

In the most preferred form, the material used in forming trays 12 and 14 such as paperboard and/or corrugated as well as the material used in forming wrapper 36 can, and for ecological reasons, should be recyclable.

Forming trays 12 and 14 from two blanks such as shown in FIGS. 2, 3, 5, and 6 is advantageous as allowing the product manufacturer to print a message on only one blank without the need to run the entire package through a printing operation. This enables the printer to run smaller pieces at a much lower price. Also, the manufacturer of the product can more easily and affordably offer a prize or game card or similar promotion on a selective basis if trays 12 and 14 are made from more than one blank.

The preferred form of package 10 utilizing independent trays 12 and 14 such as formed from the blanks of FIGS. 2 and 3 and/or utilizing separable trays 12 and 14 through the use of tear strips 40 such as shown in the blanks of FIGS. 4 and 5 allows the trays 12 and 14 to be easily separated dividing package 10 into two equal halves for distribution by the retailer or consumer after wrapper 36 is removed. Thus, the manufacturer can mix the type of products between trays 12 and 14 such as providing root beer in tray 12 and a cola in tray 14 for ease of handling and/or marketing.

Package 10 according to the preferred teachings of the present invention is designed to reduce and minimize packaging costs and to be competitive with conventional packages presently in use for the same purpose as package 10 is intended to be used for. Additionally, wrapper 36 of package 10 allows products to be viewed therethrough for marketing and inspection purposes which is generally not allowed in conventional paperboard or corrugated packages while at the same time offers security with regard to tamper resistance.

Now that the basic teachings of the present invention have been explained, many extensions and variations will be obvious to a person having ordinary skill in the art. For example, base panels 16 and 116 have been shown and described as including rounded corners and tabs 28 segmented to create rounded corners which would approximate the outer periphery of the cylindrical products at the corners of the array of products resulting in the reduction in the width of the film required to form wrapper 36. However, base panels 16 and 116 could include square corners and tabs 28 could be provided to create square corners between the ends and sides of trays 12 and 14 according to the teachings of the present invention.

Similarly, although the products shown in package 10 of FIG. 1 are cylindrical in shape and package 10 is especially adaptable for the multi-pack beverage industry, it can be appreciated that package 10 can be utilized to contain other types of products, especially where multiple products are provided in each tray 12 and 14.

Likewise, although the blanks of the most preferred form as shown in FIGS. 2–7 are believed to be advantageous, including but not limited to providing gluing simplicity through straight line gluers, it can be appreciated that trays 12 and 14 could be formed from blanks of other configurations than as shown and described according to the preferred teachings of the present invention.

We claim:

1. Package for packaging products in a double tier including an upper tray; a lower tray, with the lower tray including a base panel and first and second end walls, with each of the end walls of the lower tray including a handgrip, with the upper tray including a base panel and first and second end walls, with the end walls of the lower tray being integrally connected to the base panel of the lower tray; and a shrink wrapper encasing the upper and lower trays and the products contained therein to hold the upper and lower trays and the products together characterized in that each of the end walls of the upper tray including a handgrip, with the handgrips of the upper and lower trays being aligned when the base panel of the upper tray is supported on the products located in the lower tray.

2. The double-tiered package of claim 1 wherein the lower and upper trays each further include first and second side walls integrally connected to the base panel about parallel, spaced fold lines; and wherein the lower and upper trays each further include means for securing the first and second side walls to the respective first and second end walls of one of the upper and lower trays.

3. The double-tiered package of claim 2 wherein the securing means secure the first and second side walls of the upper tray to the respective first and second end walls of the upper tray.

4. The double-tiered package of claim 1 wherein the first and second end walls of each of the upper and lower trays include an upper edge, with the upper edges of the first end walls and the upper edges of the second end walls being integrally connected together about a fold line.

5. The double-tiered package of claim 4 wherein the first and second end walls of the lower tray include a tear strip.

6. The double-tiered package of claim 5 wherein the tear strips are located on the opposite sides of the handgrips than the upper edges of the first and second end walls of the lower tray.

7. The double-tiered package of claim 4 wherein the base panel of the upper tray includes first and second portions which are secured together to form the base panel, with the first portion being integrally connected to the first end wall of the upper tray about a fold line, and with the second portion being integrally connected to the second end wall of the upper tray about a fold line spaced from and parallel to the fold line of the first portion.

8. The double-tiered package of claim 1 wherein the shrink wrapper is encased around the end walls of the lower tray; and wherein the shrink wrapper includes first and second openings created when the shrink wrapper was shrunk around the products in the double tier and having upper peripheries at least partially coincident with the aligned handgrips of the first and second end walls of the upper and lower trays to provide extra strength to the handgrips.

9. Package for packaging products in a double tier including an upper tray; a lower tray, with the lower tray including a base panel and first and second end walls extending upwardly from the base panel, with the upper tray including a base panel and first and second end walls extending upwardly from the base panel, with the end walls of the lower tray being connected to the base panel of the lower tray; and a shrink wrapper encasing the upper and lower trays and the products contained therein to hold the upper and lower trays and the products together, characterized in that the first and second end walls of the upper and lower trays are connected together at a location above the base panel of the upper tray when the base panel of the upper tray is supported on the products located in the lower tray on the base panel and intermediate the first and second end walls.

10. The double-tiered package of claim 9 wherein the first and second end walls of each of the upper and lower trays include an upper edge, with the upper edges of the first end walls and the upper edges of the second end walls being integrally connected together about a fold line.

11. The double-tiered package of claim 10 wherein the base panel of the upper tray includes first and second portions which are secured together to form the base panel, with the first portion being integrally connected to the first end wall of the upper tray about a fold line, and with the second portion being integrally connected to the second end wall of the upper tray about a fold line spaced from and parallel to the fold line of the first portion.

12. The double-tiered package of claim 9 wherein the first and second end walls of the lower tray include a tear strip.

13. The double-tiered package of claim 9 wherein the end walls of the upper tray are integrally connected to the base panel of the upper tray.

14. The double-tiered package of claim 9 wherein the lower and upper trays each further include first and second side walls integrally connected to the base panel about parallel, spaced fold lines; and wherein the lower and upper trays each further include means for securing the first and second side walls to the respective first and second end walls of one of the upper and lower trays.

15. The double-tiered package of claim 14 wherein the securing means secure the first and second side walls of the upper tray to the respective first and second end walls of the upper tray.

16. The double-tiered package of claim 9 wherein the lower and upper trays each further include first and second side walls integrally connected to the base panel about parallel, spaced fold lines; wherein the lower and upper trays each further include means for securing the first and second side walls to the respective first and second end walls of one of the upper and lower trays; and wherein the end walls of the upper tray are not directly connected to the base panel of the upper tray.

17. Package for packaging products including a tray including a base panel and first and second end walls integrally connected to the base panel about first and second fold lines, with each of the end walls including a handgrip, with the products being supported upon the base panel intermediate the end walls; and a shrink wrapper encased around the base panel, the end walls, and the products supported upon the base panel, with the shrink wrapper drawing the end walls against the products supported upon the base panel, with the shrink wrapper including first and second openings created when the shrink wrapper was shrunk around the products and the tray, with the handgrips being accessible through the openings, characterized in the openings created when the shrink wrapper was shrunk around the products and the tray having upper peripheries at least partially coincident with the upper periphery of the handgrips of the respective first and second end walls, with the shrink wrapper providing extra strength to the handgrips in the end wall.

18. The package of claim 17 wherein the tray further includes first and second side walls integrally connected to the base panel about third and fourth fold lines, with the shrink wrapper drawing the side walls against the products supported upon the base panel.

19. The package of claim 18 wherein the first and second side walls each include first and second ends; and wherein the package further comprises, in combination: means for securing the first ends of the first and second side walls to the first end wall and for securing the second ends of the first and second side walls to the second end wall.

20. The package of claim 17 wherein the end walls include an outside surface engaged by the shrink wrapper when drawing the end walls against the product; and wherein the package further comprises, in combination: means for adhering the shrink wrapper to the outside surface of the end walls above the handgrips to further enhance the strength of the handgrips and reduce the tendency of the end walls to tear when gripped by the handgrips.

21. The package of claim 20 wherein the adhering means comprises a heat activated adhesive which is activated when the wrapper is shrunk.

22. Method for packaging products including the steps of: providing a tray including a base panel and first and second end walls integrally connected to the base panel about first and second fold lines, with each of the end walls including a handgrip, with the products being supported upon the base panel intermediate the end walls; enfolding a shrink wrapper around the base panel, the end walls, and the products supported upon the base panel; and shrinking the shrink wrapper to draw the end walls against the products supported upon the base panel and to create first and second openings with the handgrips being accessible through the openings, characterized in the openings having upper peripheries at least partially coincident with the upper periphery of the handgrips of the respective first and second end walls, with the shrunk shrink wrapper providing extra strength to the handgrips in the end walls.

23. The method of claim 22 further comprising the step of adhering the shrink wrapper to the end walls opposite to the products supported upon the base panel and above the handgrips to enhance the strength of the end walls to reduce the tendency of the end walls from tearing when gripped by the handgrips.

24. The method of claim 23 wherein the shrinking step comprises the step of heating the enfolded shrink wrapper; and wherein the adhering step comprises the step of providing a heat activated adhesive which is activated during the heating step.

25. Package for packaging products in a double tier including an upper tray; a lower tray, with the lower tray including a base panel and first and second end walls extending upwardly from the base panel, with each of the end walls of the lower tray including a handgrip, with the upper tray including a base panel and first and second end walls extending upwardly from the base panel, with the products being supported upon the base panels intermediate the end walls, with the end walls of the lower tray being integrally connected to the base panel of the lower tray; and a shrink wrapper encasing the upper and lower trays and the products contained therein to hold the upper and lower trays and the products together, with the shrink wrapper drawing the end walls against the products supported upon the base panels, with the shrink wrapper including first and second openings with the handgrips being accessible through the openings, characterized in that each of the end walls of the upper tray include a handgrip, with the handgrips of the upper and lower trays being aligned when the base panel of the upper tray is supported on the products located in the lower tray; in that the first and second end walls of the upper and lower trays are connected together at a location above the base panel of the upper tray when the base panel of the upper tray is supported on the products located in the lower tray on the base panel and intermediate the first and second end walls; and in that the openings having upper peripheries at least partially coincident with the upper periphery of the handgrips of the respective first and second end walls, with the shrink wrapper providing extra strength to the handgrips in the end walls.

26. The package of claim 17 further comprising, in combination: an upper tray, with the upper tray including a base panel and first and second end walls, characterized in that each of the end walls of the upper tray include a handgrip, with the handgrips of the upper tray and the tray being aligned when the base panel of the upper tray is supported on the products located in the tray.

27. The package of claim 17 further comprising, in combination: an upper tray, with the upper tray including a base panel and first and second end walls extending upwardly from the base panel, characterized in that the first and second end walls of the upper tray and the tray are connected together at a location above the base panel of the upper tray when the base panel of the upper tray is supported on the products located in the tray on the base panel and intermediate the first and second end walls.

* * * * *